United States Patent [19]

Haddon

[11] 4,347,986

[45] Sep. 7, 1982

[54] SELF-ATTRITIONING PULVERIZER

[76] Inventor: Lawrence D. Haddon, 350 East Ave., R 4, Palmdale, Calif. 93550

[21] Appl. No.: 109,050

[22] Filed: Jan. 2, 1980

[51] Int. Cl.[3] ..... B02C 19/00

[52] U.S. Cl. ..... 241/74; 241/284; 241/285 R

[58] Field of Search ..... 241/74, 24, 26, 5, 275, 241/284, 285 R, 285 A, 285 B, 186 R

[56] References Cited

U.S. PATENT DOCUMENTS

| | | | |
|---|---|---|---|
| 2,637,502 | 5/1953 | Bond | 241/186 R |
| 2,992,784 | 7/1961 | Behnke et al. | 241/275 |
| 3,995,814 | 12/1976 | Alberts | 241/275 X |
| 4,060,204 | 11/1977 | Williford | 241/74 |
| 4,226,375 | 10/1980 | Cameron | 241/285 B |

*Primary Examiner*—Mark Rosenbaum

*Attorney, Agent, or Firm*—Fulwider, Patton, Rieber, Lee & Utecht

[57] ABSTRACT

There is disclosed a self-attritioning pulverizer incorporating a cylindrical shell having a reduced-in-diameter, cylindrical sizing screen assembly telescoped concentrically thereinto and separated therefrom by an annular collection chamber. Mounted on the interior of such screen assembly are a plurality of equally spaced, axially extending radial holding baffles terminating at their radially inner sides in blunt edges cooperating together to form the radial interior of an annular holding chamber. A four bladed cruciform impeller is rotatably mounted from one end wall of such cylinder in coaxial relationship with such cylindrical shell with the radially outer extremities of such blades terminating in blunt edges spaced, as such impeller is rotated past such baffles, a radial distance from the edges of such baffles at least as great as the minimum cross-sectional dimension of unreduced chunks to be pulverized thereby. Conveniently, an end door is hingedly mounted to the opposite end of such shell and has a hopper mounted thereon for receiving such unreduced chunks and feeding them into the impeller. In the preferred embodiment, radial lands are provided on the interior of the door and end wall to maintain chunks revolved about by the impeller spaced from such walls to inhibit wearing thereof.

11 Claims, 4 Drawing Figures

SELF-ATTRITIONING PULVERIZER

BACKGROUND OF THE INVENTION

1. Field of the Invention

This invention relates to a pulverizer for self-attritioning products such as ore by wearing it upon itself within a cylinder for particle sizing.

2. Description of the Prior Art

There have been proposed many different grinding and pulverizing machines to reduce mine run ore or other products to a suitable size for later processing thereof. The principle purposes of these mechanisms is to produce fine size particles of fairly uniform size to either liberate a mineral content from waste rock, size it for floatation requirements or in other processes to powder plastic to free material embedded therein such as teflon shavings or gold pieces. There are not prior art devices known to applicant which rely entirely upon self-attritioning for reduction of the products being reduced.

SUMMARY OF THE INVENTION

Grinding and crushing machines have been proposed which employ hammers, balls, tubes or rods, each of which employ a foreign body to pound and grind the material and frequently result in the foreign bodies sloughing off in the crushing and grinding operation to contaminate the discharge tailings. Other prior art grinding or crushing mills operate on a batch basis requiring charging of the device with sequential batches of unprocessed material, activation of the device to grind or crush the material and then stopping of the device while the processed material is removed. Such devices are extremely time consuming and expensive to operate.

Other devices have been proposed for grinding or crushing material to be reduced wherein the material is worn, ground or sheared in direct contact with the wall, blade, impeller or other operative structure of the device itself, thus resulting in rapid wear and deterioration of such direct contacted element. These devices suffer the shortcoming that the work life of the contact element is extremely limited, thus requiring considerable down time for replacement of worn parts and resulting in a prohibitively expensive operation. Thus, there exists a need for a pulverizer which can operate in a continuous manner ingesting unreduced chunks of material for reduction thereof and continually discharging the reduced particles while operation thereof continues.

The pulverizer of the present invention is characterized by a concentric interior cylindrical sizing screen assembly received within an exterior shell and cooperating therewith to form therebetween an annular collection chamber. Mounted on the interior of the screen assembly are equally spaced axial holding baffles cooperating together to define an annular holding chamber. A coaxial impeller is rotatably mounted from one end wall of the shell and includes a plurality of impeller blades projecting radially outwardly to terminate in blunt edges spaced a distance from the radially inner extremities of the baffles a distance at least as great as the minimum transverse cross-section of chunks of the unreduced material to be ingested in such pulverizer. Consequently, rotation of the impeller at high speeds will throw the initial chunks radially outwardly into the spaces between adjacent baffles where they will be retained in a stationary position and against which subsequent chunks will wear as they are orbited about by the impeller to thus reduce the chunks by self-attrition for discharge of the reduced particles radially outwardly through the cylindrical sizing screen assembly and into the collection chamber.

Other objects and advantages of the present invention will become apparent from the following detailed description taken in conjunction with the accompanying drawings.

DESCRIPTION OF THE PREFERRED EMBODIMENT

Figure 2:
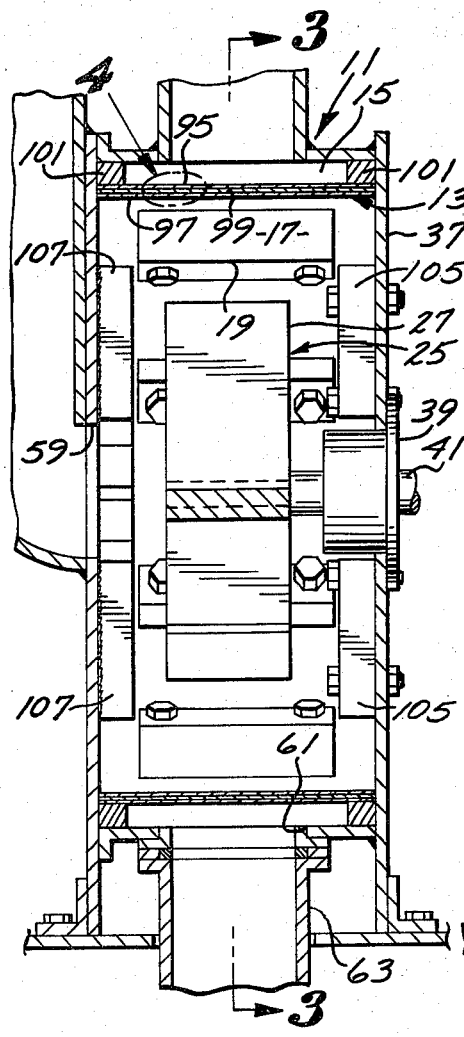
FIG. 2 is a vertical sectional view, in enlarged scale, taken along the line 2—2 of FIG. 1.
Figure 3:
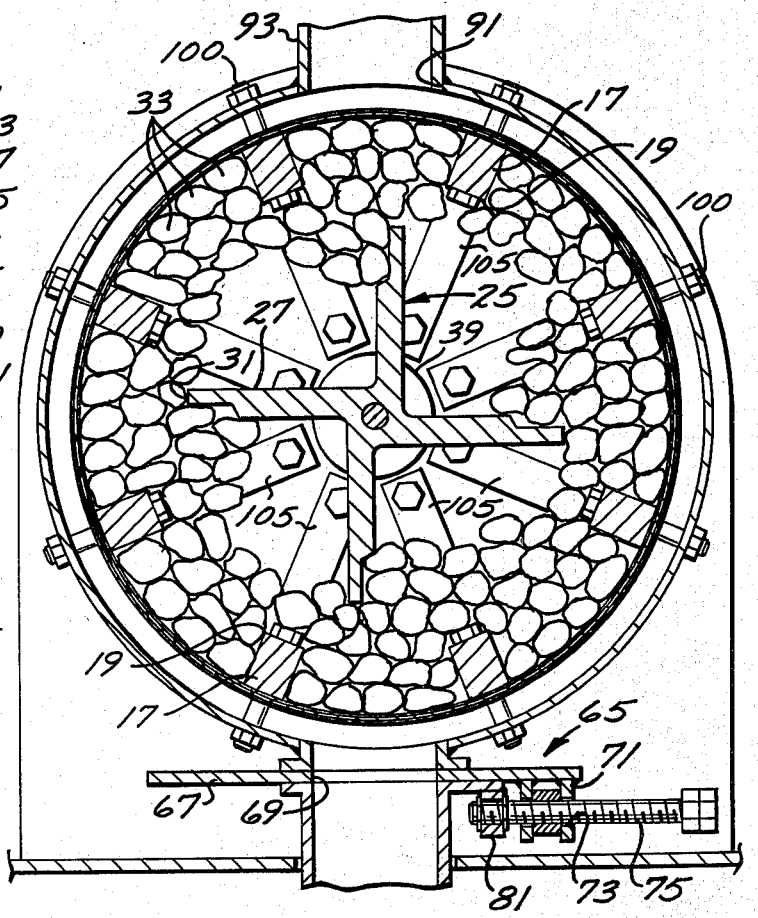
FIG. 3 is a vertical sectional view taken along the line 3—3 of FIG. 2 and depicting therein unreduced chunks of a product being reduced; and, FIG. 4 is a detailed view, in enlarged scale, taken from the circle designated 4 in FIG. 2.

Referring to FIGS. 2 and 3, the self-attritioning pulverizer of the present invention includes, generally, a horizontally disposed cylindrical shell 11 having a coaxial, reduced-in-diameter, cylindrical sizing screen assembly 13 mounted therein and cooperating therewith to form an annular collection chamber 15. Referring to FIG. 3, mounted on the interior of such cylindrical sizing screen assembly 13, are a plurality of axial baffles 17 which project radially inwardly to terminate in respective blunt edges 19 cooperating together to form the outline of a cylinder. Rotatably mounted from the shell 11 is a coaxial cruciform impeller, generally designated 25, formed with a plurality of radially projecting blades 27 terminating in blunt ends 31 spaced a distance from the radially interior edges 19 of the baffle 17, at least as great as the minimum cross-sectional dimension of the chunks of unreduced material to be ingested by such pulverizer. Consequently, when such chunks 33 are ingested into the pulverizer and the impeller 25 rotated at high speeds, the initial chunks 33 introduced will be thrown radially outwardly into the spaces between adjacent baffles 17 to be held stationary therein. As ingestion of such chunks continues, the annular spaces defined between adjacent baffles 17 will be filled and subsequent chunks 33 being orbited about within the shell 11 by the impeller 25 will be thrown radially outwardly against the chunks 33 being held stationary thus causing the surfaces of the orbiting chunks to wear against the surfaces of stationary chunks resulting in attrition thereof and discharge of the fully reduced particles radially outwardly through the sizing screen assembly 13.

Figure 1:
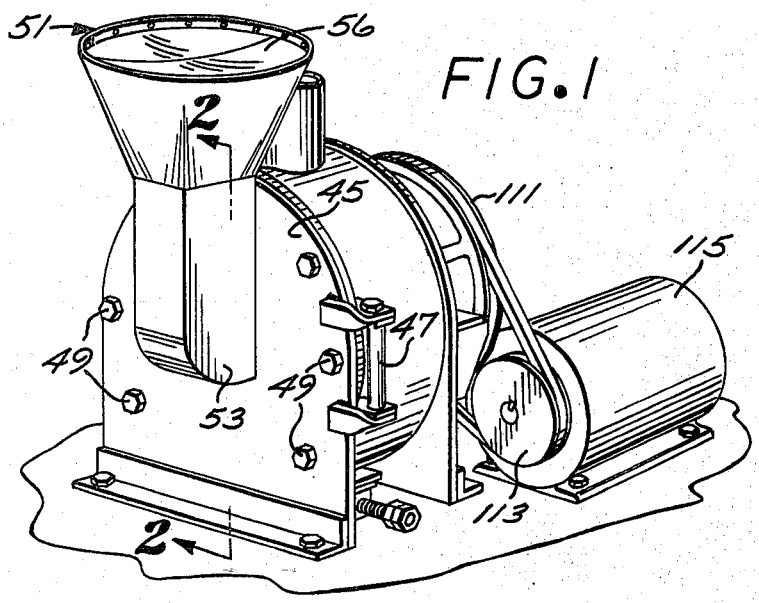
FIG. 1 is a perspective view of a pulverizer embodying the present invention.

The exterior shell 11 is closed on one end by a doughnut shaped plate defining a back wall 37 which has a hub 39 mounted centrally therein for supporting the impeller shaft 41 mounting the blades 27. Referring to FIG. 1, the front end of the shell 11 is closed by a door 45 hingedly mounted to such shell by a hinge assembly 47 and maintained in its closed position by studs 49 which may be removed for opening of the door 45 for access to the baffles 17 for periodic replacement thereof. Still referring to FIG. 1, a feed hopper, generally designated 51, is mounted to the door 45 and includes a chute 53 leading downwardly from the bottom end thereof to an inlet 59 formed centrally in the door 45. The hopper 51 may be covered by a cover 56 to prevent escape of dust and retain processed particles within the pulverizer itself.

The exterior shell 11 is formed in its bottom side with a particle outlet 61 and has a gravity discharge conduit 63 connected therewith. A control valve, generally designated 65, is mounted on the conduit 63 and includes a slide 67 formed centrally with an opening 69 which is selectively registrable with the interior of the conduit 63 for passage of particles therethrough. Depending from one end of the slide 65 is a bracket 71 having a threaded bore 73 formed therein for receipt of a threaded shaft 75 having a hex nut 77 on one end thereof. The opposite end of such shaft 75 is received freely rotatable in an anchor bracket 81 whereby the rod 75 may be rotated to draw the slide 65 in and out for controlling flow through the conduit 63.

Still referring to FIGS. 2 and 3, formed in the upper side of the shell 11 is a particle outlet 91 having a vacuum draw outlet conduit 93 received therein. The conduit 93 may be connected with a vacuum supply to provide a vacuum thereto for drawing reduced particles upwardly through the outlet 91.

Figure 4:
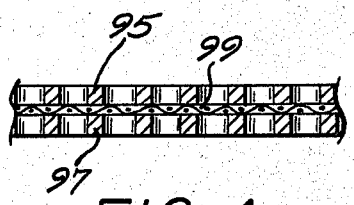

Referring to FIGS. 2 and 4, the sizing screen assembly 13 is constructed of a pair of concentric cylinders 95 and 97 formed by of perforated metal and having sandwiched therebetween, a cylindrical screen 99 of a mesh sufficient to provide for radial passage therethrough of the size of reduced particle desired. The baffles 17 are preferrably rectangular in cross-section and drawn radially outwardly against the interior of the screen assembly by means of nut and bolt assemblies 100 (FIG. 3), connected with the outer shell 11. Still referring to FIG. 2, a plurality of circular spacer rings 101 are interposed between the shell 11 and the sizing screen assembly 13 to define the annular collection chamber.

Mounted on the radially interior of the back end wall 37 and front door 45, respectively, are radially projecting lands 105 and 107. Such lands 105 and 107 serve to trap therebetween unreduced chunks 33 to hold such chunks substantially stationary and provide for wearing against the axially inner surfaces thereof by other chunks 33 being orbited about by the impeller 25 thus protecting the end wall 37 and door 45 from excessive wear due to frictional engagement with the moving chunks.

Referring to FIG. 1, the impeller shaft 41 is directly coupled with a fly wheel 111 which may be connected either directly or indirectly to the pulley 113 of a drive motor 115.

In operation, when it is desirable to reduce chunks 33, the door 45 is retained in its closed position and the motor 105 started to commence rotation of the impeller 25 about within the chamber defined within the sizing screen assembly 13. Chunks 33 to be processed are then introduced through the hopper 51 and will pass downwardly through the chute 53 through the inlet 59 (FIG. 2) to engage the revolving impeller 25. The impeller normally rotates in the neighborhood of 800 rpm and will throw the chunks 33 centrifugally outwardly toward the wall of the sizing screen assembly 13 to be entrapped in the annular space between adjacent ones of the baffle 17. As the supply of chunks 33 so thrown radially outwardly builds up in the annular space between the baffles, the entire space between adjacent baffles will be filled radially inwardly to the cylindrical interface defined by the collective radial inner edges 19 of the baffles 17 causing the radially inner surfaces thereof to project radially inwardly of such interface cylinder defined by the collective radially inner edges 19 of the baffles 17.

Subsequently, ingested chunks 33 not so held between the baffles 17 will then be carried about in an orbital path by the impeller 25 and will be urged radially outwardly against the radially inner surface of the chunks 33 held substantially immobile by the baffles 17. The chunks 33 so orbited about will thus wear against the radially inner surfaces of such stationary chunks causing attrition as a result of relative movement between the chunks and the reduced particles separated will be thrown radially outwardly to pass radially outwardly through the perforations in the perforated cylinders 95 and 97 supporting the screen 99 and also through the mesh in the screen 99 itself. The particles so separated will then be collected in the collection chamber 15 for discharge either downwardly through the bottom outlet 61 into the gravity discharge conduit 63 or upwardly through the vacuum discharge outlet 91 into the vacuum discharge conduit 93.

It will be noted that chunks 33 will also be thrown axially outwardly from the rotating impeller 25 to be entrapped between the lands 105 and 107 on the back wall 37 and front door 45 respectively, to thus be retained in a generally stationary location for wearing thereagainst by other chunks being carried about by the impeller. Not only does this function serve to provide for additional attrition, but serves to protect the interior surface of the back wall 37 and of the door 45 from excessive wear due to continuous rubbing against of the chunks 33. It will be noted that in certain instances it is desirable to draw off only the finest reduced particles and in such cases, the gravity valve 65 is closed and the vacuum applied to the vacuum conduit 93 is regulated to provide a partial vacuum sufficient to draw off the particles of the desired fineness. As attrition of the chunks 33 continues, further chunks may be introduced into the hopper 51 and the reduced particles continually drawn from either the gravity discharge conduit 63 or vacuum discharge conduit 93. Thus, a continuous pulverizing process is achieved. It will be appreciated that in certain applications it is desirable to wet the chunks 33 to accelerate attrition thereof.

While the self-attritioning process described above serves to provide for a long service free life of the baffles 17, they will eventually become worn and may easily and conveniently be replaced by merely opening the door 45, loosening the nut and bolt assemblies 100 to replace such baffles with new or reconditional baffles.

From the foregoing, it will be apparent that the pulverizer of the present invention provides for attrition of the unpulverized product to provide for size reduction without excessive wear of the pulverizer parts.

I claim:

1. A self-attritioning pulverizer for reducing chunk material to a powder and comprising:

a cylindrical shell including a peripheral wall and front and back end walls, said front wall being formed with a feed opening and said peripheral wall being formed with a outlet opening;

cylindrical screen means received in telescopical relationship in said shell and open on at least the end facing said feed opening, said screen means cooperating with said shell to form an annular screened particle collection chamber in communication with said outlet;

an axially disposed impeller received coaxially in said screen means and rotatably mounted from said back wall of said shell, said impeller including an axial shaft and a plurality of radially outwardly projecting blades terminating in radial outer ends;

an array of axial baffles spaced in a cylindrical pattern about said screen means and projecting radially inwardly therefrom to terminate in blunt edges, spaced radially outwardly of said radial outer ends of said blades, said baffles cooperating together to define therebetween an annular holding zone, and said blunt edges cooperating together to form a substantially cylindrically shaped outline defining an attrition interface for projection radially inwardly therepast of such chunks to cause any chunks held in said holding zone with the respective radially innermost surfaces thereof projecting radially inwardly past said attrition interface to be rubbed by confronting surfaces of the chunks circulated about by said impeller to thus reduce the held chunks and circulated chunks; and drive means coupled with said impeller for rotation thereof whereby said chunks of material to be reduced may be fed progressively into said cylindrical screen means through said feed opening and said drive means actuated to rotate said impeller to cause said chunks to be orbited about by said impeller to be progressively thrown centrifugally outwardly into said holding zone to be retained by said baffles against orbiting and as said chunks build up in said holding zone the radially innermost surfaces of the chunks disposed radially inwardly in said zone will be held projecting radially inwardly past said interface and as further chunks are fed into said feed inlet, said further chunks will be orbited about a circular path defined by said radially innermost surfaces of the chunks retained by said baffles in said holding zone to thus wear the orbiting chunks against the retained chunks thus reducing said chunks against one another and causing the reduced particles to move radially outwardly between said retained chunks and through said screen means to be received in said collection chamber for removal through said outlet.

2. A self-attritioning pulverizer as set forth in claim 1 when:

said shell is formed with a topside and said outlet is disposed in said topside.

3. A self-attritioning pulverizer as set forth in claim 2 that includes:

a second outlet disposed in the bottom side of said shell;

discharge conduits connected with said outlets; and, control valve means for controlling discharge from said outlets.

4. A self-attritioning pulverizer as set forth in claim 1 wherein:

said screen means includes an interior perforated metal cylinder telescoped into an exterior perforated cylinder and a cylindrical screen telescoped into sandwiched relationship between said interior and exterior perforated cylinders.

5. A self-attritioning pulverizer as set forth in claim 1 that includes:

a hopper mounted on first end wall in communication with said inlet.

6. A self-attritioning pulverizer as set forth in claim 1 that includes:

a plurality of radial, axially projecting lands mounted on one of said end walls for retaining said chunks stationary with respect thereto.

7. A self-attritioning pulverizer as set forth in claim 6 that includes:

a plurality of radial, axially inwardly projecting lands mounted on the other of said end walls.

8. A self-attritioning pulverizer as set forth in claim 1 wherein:

said first wall is in the form of a door and said pulverizer includes:

hinge means mounting one side of said door to said shell; and, releasable fastener means fastening said door closed on said shell.

9. A self-attritioning pulverizer as set forth in claim 8 that includes:

a hopper mounted on said first wall in communication with said inlet.

10. A self-attritioning pulverizer as set forth in claim 1 wherein:

said feed inlet is disposed in axial alignment with said impeller.

11. A self-attritioning pulverizer as set forth in claim 1 wherein:

said cylindrical screen means includes a cylindrical screen projecting entirely from said front to said back wall and support means supporting said screen from said shell.

* * * * *